United States Patent [19]

Bonde et al.

[11] Patent Number: 5,048,478

[45] Date of Patent: Sep. 17, 1991

[54] SINGLE CYLINDER ENGINE HAVING MULTI-FUNCTIONAL BRACKET AND METHOD OF ASSEMBLING SAME

[75] Inventors: Kevin G. Bonde, Kiel; Mark T. Holschuh, Fond du lac; Lee E. Roller, West Bend, all of Wis.

[73] Assignee: Tecumseh Products Company, Tecumseh, Mich.

[21] Appl. No.: 595,788

[22] Filed: Oct. 9, 1990

Related U.S. Application Data

[63] Continuation of Ser. No. 379,485, Jul. 13, 1989, abandoned.

[51] Int. Cl.[5] ..... F02F 7/00

[52] U.S. Cl. ..... 123/195 A; 123/41.65; 123/198 E; 29/428

[58] Field of Search ..... 123/41.6, 41.65, 41.7, 123/195 R, 195 A, 195 C, 198 E, 40 D, 403; 29/156.4 R, 428

[56] References Cited

U.S. PATENT DOCUMENTS

| | | | |
|---|---|---|---|
| 3,263,663 | 8/1966 | Connell | 123/195 R |
| 3,730,147 | 5/1973 | Buchwald | 123/41.44 |
| 4,156,409 | 5/1979 | Nakano | 123/41.65 |
| 4,205,737 | 6/1980 | Harkness et al. | 192/17 R |
| 4,326,368 | 4/1982 | Hoff | 192/17 R |
| 4,519,347 | 5/1985 | Nolff | 123/195 A |
| 4,757,885 | 7/1988 | Kronich | 192/1.4 |
| 4,860,608 | 8/1989 | Kobayashi | 123/400 |

OTHER PUBLICATIONS

Brigg's Stratton Brochure-Briggs & Stratton Engine 1988.

Sears Owner's Manual, Model 143.784162 Engine, Feb. 1, 1988.

Sears Owner's Manual, Model 143.406052 Engine, Sep. 1, 1989.

*Primary Examiner*—Noah P. Kamen

*Attorney, Agent, or Firm*—Jeffers, Hoffman & Niewyk

[57] ABSTRACT

A single cylinder air-cooled internal combustion engine has a bracket which is mounted to the engine encircling the crankshaft between the flywheel and the crankcase. A plurality of engine accessories are mounted to the bracket as a subassembly prior to assembly of the bracket to the engine. The engine accessories include a safety brake, a throttle control lever, an electric starter, an alternator, a finger guard and a cooling air baffle.

29 Claims, 3 Drawing Sheets

SINGLE CYLINDER ENGINE HAVING MULTI-FUNCTIONAL BRACKET AND METHOD OF ASSEMBLING SAME

This is a continuation of application Ser. No. 379,485, filed July 13, 1989, now abandoned.

BACKGROUND OF THE INVENTION

The present invention relates generally to a single cylinder internal combustion engine and more particularly to such an engine having a plurality of accessory systems mounted thereto.

Internal combustion engines of the single cylinder air-cooled type are sometimes employed as the power source for lawn mowers and other implements requiring a rotary drive. In such applications various accessory systems are attached to the engine to enhance operator control and to promote safety. Such accessories include, among others, a deadman safety brake, throttle control levers, an electric starter, an alternator, cooling air baffles and finger guards. Each of these accessories is currently assembled to the engine block one at a time during assembly of the engine as a whole. One disadvantage of this prior construction is that a multiplicity of fasteners are employed and certain components whose individual natures lend themselves to automated assembly must nevertheless be assembled using less than optimum automation because of limitations of automating the assembly of whole engines on a build-line.

It would be desireable to provide an improved engine assembly design in which certain accessory components can be preassembled as a single subassembly which can then be assembled to the engine. This and other advantageous features are obtained by the present invention.

SUMMARY OF THE INVENTION

The present invention involves, according to one embodiment thereof, an internal combustion engine having a bracket encircling the crankshaft at the top of the crankcase and attached thereto at a few discrete points, with the bracket having assembled thereto as a subassembly a plurality of accessories including at least some of the following: a safety brake, a throttle control lever, an electric starter, and an alternator, with cooling air baffles and finger guards integrated into the bracket.

The present invention overcomes the problems discussed above in that a common bracket is provided which encircles the crankshaft proximate the flywheel, and a variety of individual components which are usually mounted in that area directly to the engine block or crankcase are pre-mounted as a subassembly to the bracket, which sub-assembly is then mounted to the crankcase. This allows for automated assembly of the sub-assembly and reduces the number of fasteners involved in final assembly.

The bracket to which the various accessories are mounted is generally flat and encircles the drive shaft between the flywheel and the crankcase. Upturned perimetric edges provide for stiffening of the bracket, and several pivot pins upon which the accessories pivot are fixed to the bracket and stand upright therefrom.

The invention, in one form thereof, involves a single cylinder air-cooled internal combustion engine having a crankcase, a crankshaft and a flywheel mounted thereto, and a bracket encircling the crankshaft and attached to the crankcase. A safety brake means selectively engageable with the flywheel for stopping rotation of the engine is provided, and the safety brake means is mounted to the bracket.

The invention, in accordance with another aspect thereof, involves a method of assembling a single cylinder air-cooled internal combustion engine having a crankcase, a crankshaft and a flywheel mounted thereto, safety brake means selectively engageable with the flywheel for stopping rotation of the engine, and a throttle control lever. The method includes the steps of providing a bracket configured to mount to the engine encircling the crankshaft, mounting the safety brake means to the bracket, mounting the throttle control lever to the bracket, and mounting the bracket with safety brake means and throttle control lever to the engine so as to encircle the crankshaft.

It is an object of the present invention to provide an improved internal combustion engine assembly with certain accessories often associated with the engine and usually mounted directly thereto in the vicinity of the flywheel, which can be assembled in a more economical manner.

It is a further object of the present invention to provide an improved internal combustion engine assembly wherein certain accessories associated therewith can be pre-assembled as a subassembly prior to final assembly to the engine.

Additional objects and advantages of the present invention will be apparent to those skilled in the pertinent art from the following descriptions and the drawings appended hereto.

DESCRIPTION OF THE PREFERRED EMBODIMENT

Figure 1:
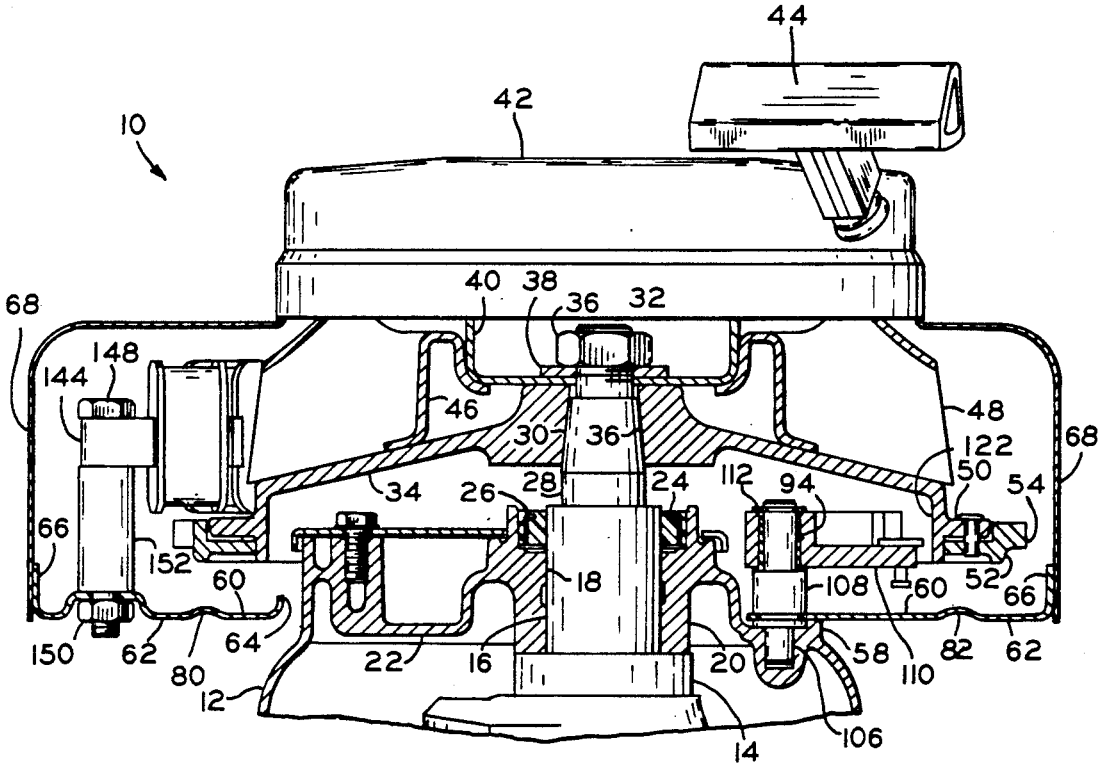
FIG. 1 is an elevational view of an engine, partly in section, particularly showing the subassembly of FIG. 1.
Figure 2:
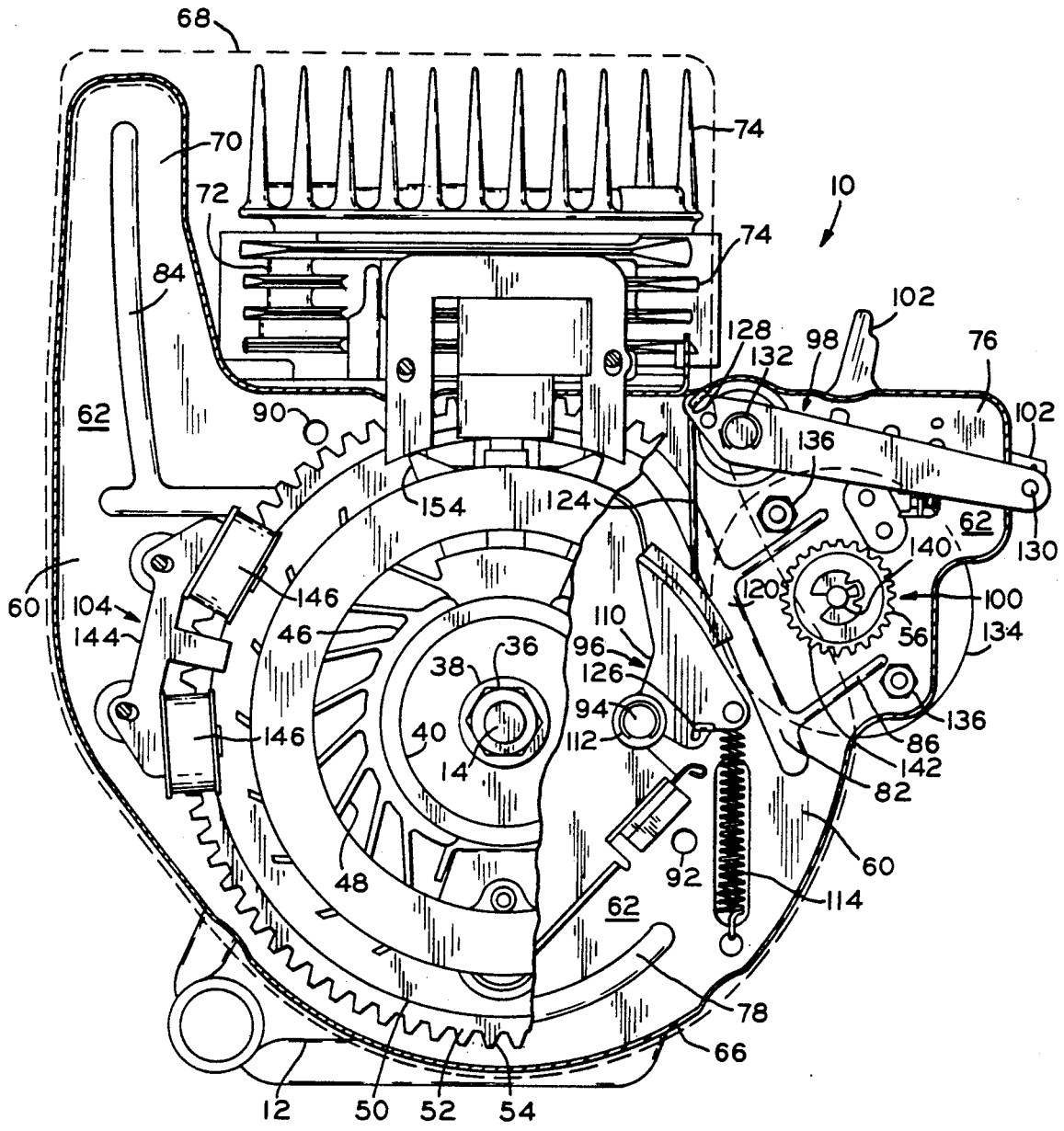
FIG. 2 is a top view of the engine of FIG. 2, with the blower housing removed and the outline thereof shown in dashed lines, and with the flywheel partially cut away to reveal the subassembly of FIG. 1 therebelow.

With reference to FIGS. 1 and 2, there is illustrated a single cylinder, air-cooled internal combustion engine 10 having a crankcase 12. A vertically oriented crankshaft 14 is disposed in crankcase 12 and has a reduced diameter portion 16 rotatably journalled in upper bearing 18 formed in sleeve 20 which is cast integrally with top wall 22 of crankcase 12. An upper oil seal 24 located in a recess 26 at the top of sleeve 20 engages reduced diameter portion 16 and seals against oil migration from crankcase 12 therepast. Crankshaft 14 has a further reduced diameter portion 28 extending upwardly out of sleeve 20 and includes a tapered section 30 and a threaded section 32 thereabove. Received on portion 28 of crankshaft 14 is a cast flywheel 34 having a tapered bore 36 which is complementary to tapered section 30 and frictionally engaged therewith and retained by a zinc key (not shown). Flywheel 34 is retained on tapered section 30 by a threaded nut 36 threadedly received on threaded section 32 and bearing on washer 38.

Disposed between washer 38 and flywheel 34 is a cup shaped member 40 which is linked via pull starter means (now shown) within cover 42 to a pull starter rope 44. Nut 36 and washer 38 clamp cup shaped member 40 to the top of flywheel 34 for rotation therewith. Attached to cup shaped member 40 radially outwardly thereof is an annular member 46 having a plurality of generally radially extending blades 48 forming a centrifugal air blower. Attached to the peripheral rim 50 of flywheel 34 is an annular ring gear 52 whose teeth 54 extend substantially radially outwardly for drive engagement with the electric starter motor, which is described further below.

Engaging the top wall 22 of crankcase 12 at boss 58 for instance is a generally horizontally disposed bracket 60 which encircles crankshaft 14, sleeve 20 and other structure on the top end of crankcase 12. Bracket 60 is preferably constructed of stamped sheet steel with a generally flat bottom wall 62 substantially perpendicular to crankshaft 14 and an upturned inner perimetric edge portion 64 and an upturned outer peripheral edge portion 66. Inner and outer edge portions 64 and 66, respectively, stand upwardly generally perpendicular to bottom wall 62 and serve to add rigidity against flexure to bracket 60 as well as providing structure to which blower housing 68 is attached. Bottom wall 62, in addition to serving structural support functions as described further below, also serves as a finger guard to keep an operator's fingers from coming into contact with the flywheel during operation of the engine.

Figure 3:
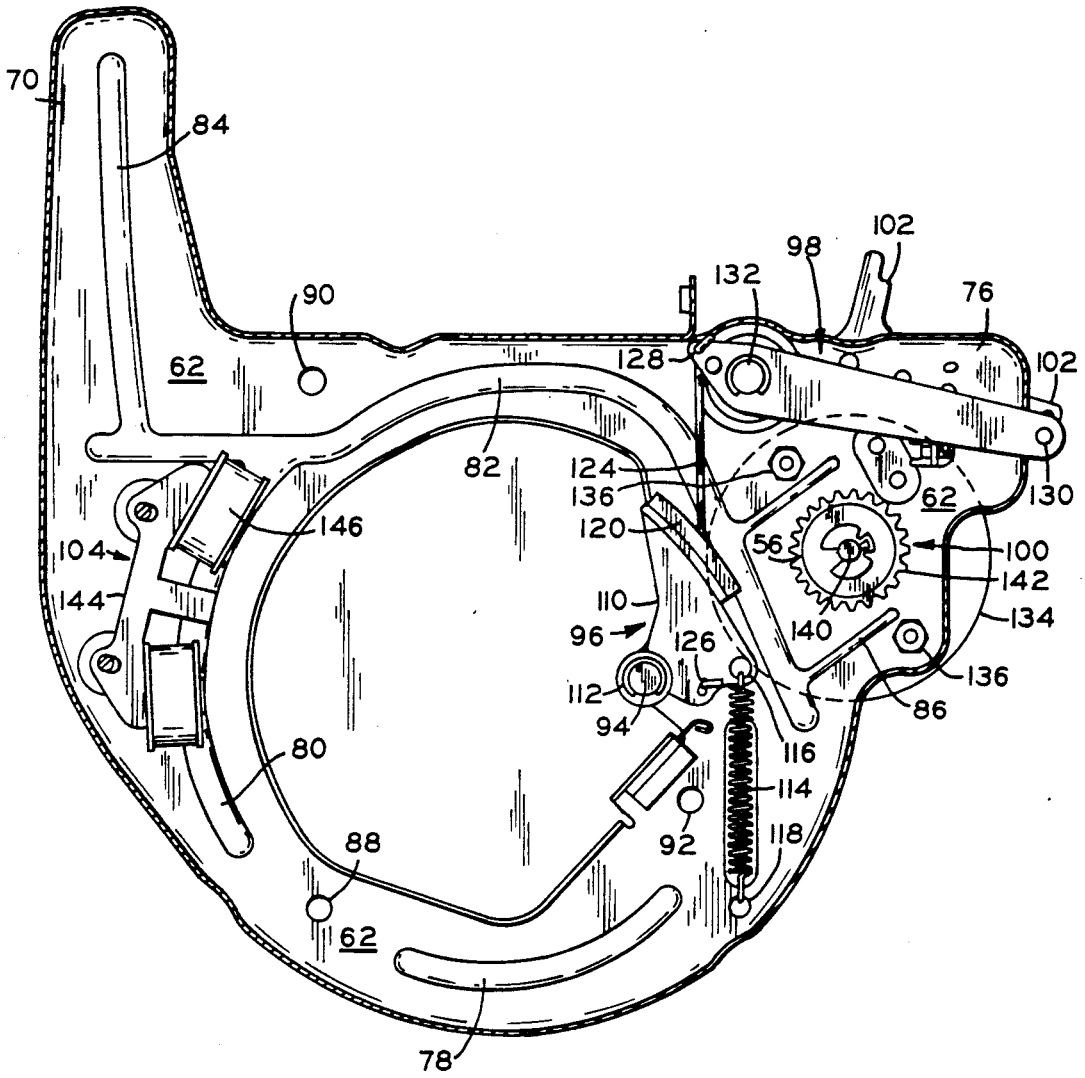
FIG. 3 is a top view of a subassembly of a bracket and various engine accessory systems mounted thereto in accordance with the present invention.

Referring to FIGS. 2 and 3 in particular, bracket 60 includes an elongated air baffle portion 70 extending alongside and generally parallel to the engine cylinder 72 which serves to block air flow generated by the rotation of air blades 48 from exiting downwardly out of blower housing 68 beside cylinder 72. Instead, air baffle portion 70 causes the air flow to be directed downwardly over cylinder 72, the cooling fins 74 of which help to dissipate heat generated by combustion. Bracket 60 also includes an extended portion 76 which supports a variety of engine accessories, as described in greater detail below. Strengthening ribs are provided in bottom wall 62 for greater rigidity by means of elongated stamped channels 78, 80, 82, 84 and 86.

Three circumferentially spaced holes 88, 90 and 92 through bottom wall 62 provide attachment points at which bracket 60 is attached to crankcase 12 by bolts received therethrough. Each threaded bolt (not shown) is threadedly received in a vertical threaded hole in a boss (not shown) on the top of crankcase 12. A stud 94 which serves as the pivot pin for the safety brake, as described further below, is received in a bore in boss 58 for accurate location of the entire assembly and the brake especially.

Referring to FIG. 3 in particular, bracket 60 is illustrated as part of a subassembly which is preferably assembled separately and apart from the assembly of engine 10 per se. In addition to bracket 60, the subassembly of FIG. 3 includes in the embodiment illustrated herein a safety brake 96 and control lever 98, an electric starter 100, throttle control levers 102, and an alternator 104.

Again referring to, FIGS. 1, 2 and 3, safety brake 96 includes pivot stud or pilot pin 94 having a lower portion 106 which extends through a hole in bottom wall 62 of bracket 60 and is received in a corresponding controlled diameter hole in boss 58 of crankcase 12. A shoulder 108 on stud 94 is disposed above bottom wall 62 and supports brake lever 110 which is pivoted on stud 94. A snap ring 112 engaging an annular groove at the top of pivot stud 94 retains brake lever 110 thereon. A coil spring 114 is attached at a first end thereof to brake lever 110 at hole 116 and at a second end thereof to a hole 118 in bracket 60. Spring 114 is so positioned as to generate a moment in brake lever 110 about pivot stud 94 in a clockwise direction as viewed in FIGS. 2 and 3, which causes brake friction pad 120 to be urged against annular inner peripheral surface 122 of flywheel 34. The geometry of brake lever 110, pivot 94, spring 114 and flywheel surface 122 is such that upon actuation of the brake, the rotation of flywheel 34 in a clockwise direction as viewed in FIGS. 2 and 3 causes the braking action to become self-energizing. Brake lever 110 is retracted from the braking position by intermediate control link 124 which is attached at one end to hole 126 of brake lever 110 and at the other end to hole 128 of control lever 98. A cable (not shown) actuated by the operator and attached to hole 130 at the opposite end of control lever 98 applies tension thereto and causes control lever 98 to pivot on pivot pin 132 which is affixed to bottom wall 62 of bracket 60 and stands upright therefrom. Such pivoting in turn applies tension to control link 124 in opposition to tension from spring 114 and generates a moment in brake lever 110 counterclockwise about pivot stud 94, thereby pivoting brake lever 110 and brake friction pad 120 away from flywheel wall 122, disengaging the brake.

Electric starter 100 includes an electric starter motor 134 oriented vertically and located below bottom wall 62 of bracket 60 and attached thereto by nuts 136 received on threaded mounting studs connected with motor 134. The shaft 140 of motor 134 extends upwardly through a hole in bottom wall 62 and has retained thereon for rotation therewith a pinion gear 142 which engages teeth 54 of ring gear 52 on flywheel 34. Bracket 60 in this regard provides a fixed attachment point relative to engine 10 upon which starter motor 134 is attached with precise spacing relative to ring gear 52, which permits an accurate mesh between pinion gear 142 and ring gear 52.

Throttle control lever 102 is pivoted on a stud attached to bottom wall 62 of bracket 60 and extending substantially perpendicular thereto. Lever 102 serves to transmit motion from a bowden cable operated by the operator to the conventional throttle lever of the carburetor (not shown). Bracket 60 and lever 102 in this regard provide a fixed point relative to the engine and carburetor for support of the carburetor control linkage.

Alternator 104 includes a core 144 and windings 146 and is attached to bottom wall 62 by bolts 148 and nuts 150 with spacer sleeves 152 received about bolts 148 between core 144 and bottom wall 62. Core 144 is thereby spaced from bottom wall 62 at a level at which it is properly aligned with flywheel 34 such that electricity is generated therein by the rotation therepast of the permanent magnet 154 of flywheel 34.

It should be understood that each of the above described accessories, namely safety brake 96 and control lever 98, electric starter 100, throttle control lever 102, and alternator 104 is first assembled and attached to bracket 60 one at a time until as many of the accessories as are desired for a particular engine have been so attached. Then the entire subassembly consisting of bracket 60 and attached accessories is attached to engine 10 as described above by means of bolts received through mounting holes 88, 90 and 92. The pivot stud 94 of the safety brake 96 is somewhat of a special case in that because of the large forces which it must transmit from flywheel 34 to crankcase 12 during braking, stud 94 is piloted directly in crankcase 12 in addition to first being attached to bracket 60 during prior assembly of the subassembly. This also provides for accurate location of the bracket 60 and especially the brake mechanism. The remaining accessories are attached only indirectly to crankcase 12 via intermediate bracket 60. It should also be noted that the advantages to be gained from prior subassembly of the various accessories to a common bracket before final assembly of the engine do not prevent any of the accessories from being designated optional. It is a simple matter to leave off one or more accessories from the bracket during subassembly if it is desired to omit certain accessories from particular engine models.

While the present invention has been particularly described in the context of a preferred embodiment, it will be understood that the invention is not limited thereby. Therefore, it is intended that the scope of the invention include any variations, uses or adaptations of the invention following the general principles thereof and including such departures from the disclosed embodiments as come within known or customary practice in the art to which the invention pertains and which fall within the appended claims or the equivalents thereof.

What is claimed is:

1. In a single cylinder air-cooled internal combustion engine having a crankcase, a crankshaft and a flywheel mounted thereto, said crankcase forming a bearing housing for said crankshaft, the improvement comprising:

a sheet metal bracket, separate from said crankcase, encircling said crankshaft and attached to the crankcase , said bracket having a plurality of accessory elements mounted thereto, said bracket overhanging said crankcase; and pilot means attached to said bracket and said crankcase for accurately locating said bracket relative to said crankcase.

2. The engine of claim 1, wherein one of said accessories is a safety brake means selectively engageable with the flywheel for stopping rotation of the engine, said safety brake means being mounted to said bracket.

3. The engine of claim 2, in which said safety brake means includes a brake lever pivotally mounted to said bracket and carrying a friction brake pad, and a control lever pivotally mounted to said bracket and linked to the brake lever by an intermediate control link.

4. The engine of claim 2, wherein another of said accessories is a throttle control lever pivotally mounted to said bracket.

5. The engine of claim 4, wherein one of said accessories is an electric motor mounted to said bracket having means for drivingly engaging said flywheel.

6. The engine of claim 5, wherein one of said accessories is an alternator mounted to said bracket in electromagnetic proximity to said flywheel.

7. The engine of claim 6, in which said bracket includes a substantially flat bottom wall substantially perpendicular to the crankshaft and an outer perimetric wall generally perpendicular to the bottom wall.

8. The engine of claim 7, in which said bracket further includes an inner perimetric wall spaced from the outer perimetric wall and extending generally perpendicular to the bottom wall.

9. The engine of claim 7, which includes a blower housing mounted to said bracket.

10. The engine of claim 1, wherein one of said accessories is a throttle control lever pivotally mounted to said bracket.

11. The engine of claim 1, wherein one of said accessories is an electric starter motor mounted to said bracket and having means for drivingly engaging said flywheel.

12. The engine of claim 1, wherein one of said accessories is an alternator mounted to said bracket in electromagnetic proximity to said flywheel.

13. The engine of claim 1, in which said bracket includes a substantially flat bottom wall substantially perpendicular to the crankshaft and an outer perimetric wall generally perpendicular to the bottom wall.

14. The engine of claim 13, in which said bracket further includes an inner perimetric wall spaced from the outer perimetric wall and extending generally perpendicular to the bottom wall.

15. The engine of claim 1, in which said engine includes a cylinder and a blower housing overlying said crankcase and said cylinder, and said bracket includes an air baffle portion extending alongside and generally parallel to the engine cylinder and blocking air flow exiting out of the blower housing beside the cylinder.

16. The engine of claim 15, in which said blower housing is attached to and supported by said bracket, and said bracket is so disposed as to prevent contact of an operator's fingers with the flywheel.

17. The engine of claim 1 wherein said bracket includes a bottom wall having stiffening ribs formed therein.

18. The engine of claim 1 wherein said pilot means comprises a pilot pin fastened to said bracket and being received in a closely fitting opening in said crankcase.

19. In a single cylinder air-cooled internal combustion engine having a crankcase, a crankshaft and a flywheel mounted thereto, said crankcase forming a bearing housing for said crankshaft, the improvement comprising:

a sheet metal bracket, separate from said crankcase, attached to and overhanging the crankcase adjacent to and substantially perpendicular to the crankshaft;

safety brake means selectively engageable with the flywheel for stopping rotation of the engine, said safety brake means being mounted to said bracket;

a throttle control level pivotally mounted to said bracket;

an electric starter motor mounted to said bracket and having means for drivingly engaging said flywheel; and an alternator mounted to said bracket in electromagnetic proximity to said flywheel.

20. The engine of claim 19, in which said bracket includes a substantially flat bottom wall substantially perpendicular to the crankshaft and an outer perimetric wall generally perpendicular to the bottom wall.

21. The engine of claim 20, in which said bracket further includes an inner perimetric wall spaced from the outer perimetric wall and extending generally perpendicular to the bottom wall.

22. The engine of claim 21, in which said engine includes a cylinder and a blower housing overlying said crankcase and said cylinder, and said bracket includes an air baffle portion extending alongside and generally parallel to the engine cylinder and blocking air flow exiting out of the blower housing beside the cylinder.

23. The engine of claim 19 wherein said bracket includes a bottom wall having stiffening ribs formed therein.

24. A method of assembling a single cylinder air-cooled internal combustion engine having a crankcase, a crankshaft and a flywheel mounted thereto, safety brake means selectively engageable with the flywheel for stopping rotation of the engine, and a throttle control lever, said method comprising the steps of:

providing a bracket configured to mount to said engine encircling said crankshaft;

mounting said safety brake means to said bracket;

mounting said throttle control lever to said bracket; and mounting said bracket with safety brake means and throttle control lever to said engine to encircle said crankshaft.

25. The method of claim 24, and further including the steps of:

providing a starter motor configured to drivingly engage the flywheel; and mounting the starter motor to said bracket prior to mounting said bracket to said engine.

26. The method of claim 25, and further including the steps of:

providing an alternator electromagnetically responsive to said flywheel; and mounting the alternator to said bracket prior to mounting said bracket to said engine.

27. The method of claim 24 including mounting a pilot pin to said bracket, and wherein the step of mounting the bracket to the engine includes inserting the pilot pin into a closely fitting opening in said crankcase to thereby accurately locate said bracket to said engine.

28. In a single cylinder air-cooled internal combustion engine having a crankcase, a crankshaft and a flywheel mounted thereto, said crankcase forming a bearing housing for said cankshaft, the improvement comprising:

a sheet metal bracket, separate from said crankcase, encircling and extending radially outward relative to the crankshaft and attached to the crankcase, said bracket overhanging said crankcase; and a plurality of accessories mounted to said bracket, wherein said accessories are selected from the group consisting of:

safety brake means selectively engageable with the flywheel for stopping rotation of the engine;

a throttle control level pivotally mounted to said bracket;

an electric starter motor having means for drivingly engaging said flywheel; and an alternator in electromagnetic proximity to said flywheel.

29. The engine of claim 28 wherein said bracket includes a bottom wall having stiffening ribs formed therein.

* * * * *